US008603925B2

(12) United States Patent
Koide et al.

(10) Patent No.: US 8,603,925 B2
(45) Date of Patent: Dec. 10, 2013

(54) LEATHER-LIKE SHEET MATERIAL, PROCESS FOR PRODUCTION THEREOF, AND INTERIOR, CLOTHING AND INDUSTRIAL MATERIALS MADE BY USING THE SAME

(75) Inventors: Gen Koide, Anpachi-gun (JP); Nobuhiro Maeda, Otsu (JP); Masaru Ueno, Anpachi-gun (JP); Yoshikazu Yakake, Omihachiman (JP)

(73) Assignee: Toray Industries, Inc., Tokyo (JP)

( * ) Notice: Subject to any disclaimer, the term of this patent is extended or adjusted under 35 U.S.C. 154(b) by 502 days.

(21) Appl. No.: 12/095,428

(22) PCT Filed: Nov. 27, 2006

(86) PCT No.: PCT/JP2006/323620
§ 371 (c)(1),
(2), (4) Date: Oct. 3, 2008

(87) PCT Pub. No.: WO2007/063811
PCT Pub. Date: Jun. 7, 2007

(65) Prior Publication Data

US 2009/0286436 A1 Nov. 19, 2009

(30) Foreign Application Priority Data

Nov. 30, 2005 (JP) ..... 2005-345356

(51) Int. Cl.
*B32B 5/00* (2006.01)

(52) U.S. Cl.
USPC ..... 442/59; 442/275; 442/319

(58) Field of Classification Search
USPC ..... 442/59, 275, 319
See application file for complete search history.

(56) References Cited

U.S. PATENT DOCUMENTS

| | | | | |
|---|---|---|---|---|
| 6,322,851 | B1 * | 11/2001 | Adachi et al. | 427/246 |
| 6,794,446 | B1 * | 9/2004 | Takeda et al. | 524/590 |
| 2005/0009985 | A1 * | 1/2005 | Selbertinger et al. | 524/589 |
| 2005/0118394 | A1 * | 6/2005 | Tanaka et al. | 428/151 |
| 2007/0197116 | A1 * | 8/2007 | Yakake et al. | 442/340 |

FOREIGN PATENT DOCUMENTS

| | | | |
|---|---|---|---|
| JP | 11-279956 | A | 10/1999 |
| JP | 2001-055670 | | 2/2001 |
| JP | 2002-317386 | | 10/2002 |
| JP | 2003-138131 | A | 5/2003 |
| JP | 2003-201679 | A | 7/2003 |
| JP | 2003-336178 | A | 11/2003 |
| JP | 2004-143641 | A | 5/2004 |
| JP | 2005-076157 | A | 3/2005 |
| JP | 2005-126848 | A | 5/2005 |
| JP | 2005-248415 | | 9/2005 |
| WO | WO 2005095706 | A1 * | 10/2005 |

OTHER PUBLICATIONS

International Search Report dated Feb. 27, 2007, application No. PCT/JP2006/323620.

* cited by examiner

*Primary Examiner* — Peter Y Choi
(74) *Attorney, Agent, or Firm* — RatnerPrestia

(57) ABSTRACT

The invention provides a leather-like sheet material which is excellent in surface appearance, texture and physical properties and considerate of the environment; a process for the production thereof; and interior, clothing, and industrial materials made by using the same. A leather-like sheet material made from a nonwoven fabric which is constituted of ultra-fine fibers having a mean single-fiber fineness of 0.001 to 0.5 dtex and impregnated with a self-emulsifiable polyurethane, wherein the self-emulsifiable polyurethane and the ultra-fine fibers do substantially not adhere closely to each other, the moieties of the polyurethane have a nonporous structure, and the polyurethane has a structure crosslinked by siloxane bond in the molecular structure.

11 Claims, 1 Drawing Sheet

LEATHER-LIKE SHEET MATERIAL, PROCESS FOR PRODUCTION THEREOF, AND INTERIOR, CLOTHING AND INDUSTRIAL MATERIALS MADE BY USING THE SAME

This is a U.S. National Phase application of application number PCT/JP2006/323620, filed Nov. 27, 2006, (which is incorporated herein by reference in its entirety), which claims priority benefit of JP 2005-345356 filed Nov. 30, 2005.

TECHNICAL FIELD

This invention relates to a leather-like sheet material with excellent outward appearance, texture and physical properties and which is considerate of the environment, to its manufacturing method and to interior, clothing and industrial materials that use it.

BACKGROUND ART

Leather-like sheet material principally composed of ultra-fine fibers and polyurethane has outstanding characteristics not found in natural leather and can be widely used in a variety of ways.

Among these, because of their excellent light resistance properties, leather-like sheet materials using polyester ultra-fine fibers in particular have been used more and more each year in clothing and upholstering and for automobile interiors.

In manufacturing such leather-like sheet materials, a process wherein nonwoven fabric composed of ultra-fine fiber generating type fibers is processed in an organic solvent causing ultra-fine fibers to be appeared is commonly combined with a process wherein, after the nonwoven fabric is impregnated in an organic solvent solution, the fiber sheet material is immersed and cleaned in water, a non-solvent for polyurethane, or in an organic solvent aqueous solution and the polyurethane is caused to undergo wet process hardening.

In the process for appearing ultra-fine fibers, toluene and trichloroethylene or the like are used as organic solvents and a water-miscible organic solvent such as N,N-dimethylformamide used as the polyurethane organic solvent.

However, because organic solvents are highly deleterious to the human body and the environment, when the leather-like sheet materials are manufactured, using a method which does not employ organic solvents is strongly called for.

As a specific resolution step for this requirement, for example, with regard to the process for appearing the ultra-fine fibers, a method wherein ultra-fine fiber processing of fibers is carried out using an alkaline aqueous solution or heating by using an alkaline water solution soluble component or a hot water soluble component for the ultra-fine fiber generating fibers, and with regard to the use of organic solvents for the polyurethane, a method using polyurethane aqueous dispersion in which polyurethane is dispersed in water substituting for a conventional organic solvent type polyurethane are being investigated.

For example, in Patent Document 1, a leather-like sheet manufacturing method is proposed wherein nonwoven fabric composed of fibers for which alkaline extraction is possible is impregnated in a polyurethane aqueous dispersion solution having heat-sensitive gelling characteristics and then extracted in an alkaline aqueous solution. By using a polyurethane aqueous dispersion solution having heat-sensitive gelling characteristics, polyurethane migration when drying after the polyurethane impregnation is suppressed and the texture of the leather-like sheet is made flexible. However, because surfactants are used in this method to impart heat-sensitive gelling characteristics to the polyurethane, surface tackiness is easily generated because of bleeding of the surfactants and as a result, a cleaning process is required after the polyurethane impregnation. Furthermore, because of the presence of the surfactants, fusion of the polyurethane emulsion is easily prevented at film forming time and the film strength of the polyurethane is decreased as is the friction resistance of the sheet material.

Furthermore, in Patent Document 1, appearing the ultra-fine fibers is done with processing in an alkaline aqueous solution after the polyurethane impregnation, but polyurethane generally is easily hydrolyzed in an alkaline aqueous solution. In Patent Document 1, an attempt is made to improve the hydrolysis resistance in an alkaline aqueous solution with polyether or polycarbonate as a polyol, but considering that the urethane bond and the urea bond of the polyurethane are easily hydrolyzed bonds, the separation of the polyurethane during the alkaline aqueous solution processing cannot be controlled and the strength and friction resistance of the sheet material drop remarkably rendering it insufficient for practical use.

In Patent Document 2, a manufacturing method is proposed wherein nonwoven fabric is impregnated after a cross-linking agent is added beforehand to the polyurethane aqueous dispersion solution. By combining with a cross-linking agent, the durability of the polyurethane impregnated nonwoven fabric is improved but when considering its production, when a cross-linking agent is added to and maintained in a polyurethane aqueous dispersion solution, gelling is easily produced because of changes over time and pot life is short.

In Patent Document 3, a manufacturing method is proposed wherein, with the objective of adding suppleness to the polyurethane impregnated nonwoven fabric, polyvinyl alcohol is added to the nonwoven fabric consisting of fibers having a sea component which may be extracted by alkali treatment and then it is impregnated with a polyurethane aqueous dispersion solution. Strengthening the physical properties of the nonwoven fabric during the processing time by adding polyvinyl alcohol, and suppleness of the polyurethane impregnated nonwoven fabric by removal of the paste (removal of the polyvinyl alcohol) after the polyurethane aqueous dispersion solution is imparted polyurethane aqueous dispersion nonwoven fabric are attained. However, it is necessary to go through the two processes of adding the polyvinyl alcohol and removing the paste (removal of the polyvinyl alcohol) and the manufacturing process for the leather-like sheet material becomes extremely long and manufacturing costs increase.

Additionally, it becomes necessary for the leather-like sheet material to have an even higher level of durability.

If it is only intended to increase the friction resistance, high molecular weight elastic bodies may be added in large quantities but if they are added to excess, the texture hardens and suppleness and the quality of the outward appearance, which are characteristics of the original product, are lost. As a result, methods for modifying high molecular weight elastic bodies to obtain highly durable leather-like sheet materials are also being investigated, but so far no products have been obtained with supple texture, excellent outward appearance and durability using polyurethane aqueous dispersion solutions that do not use organic solvents.

Patent Document 1: Japanese patent application Tokkai Publication No. 2001-55670

Patent Document 2: Japanese patent application Tokkai Publication No. 2005-248415

Patent Document 3: Japanese patent application Tokkai Publication No. 2002-317386

DISCLOSURE OF INVENTION

In light of the above described points, the objective of this invention is to provide a leather-like sheet material with outstanding outer surface appearance, texture and physical properties which is considerate of the environment, to present its manufacturing method and to provide interior, clothing and industrial materials which use it.

The leather-like sheet material of this invention which attains the above-described objective is a leather-like sheet material which contains self-emulsifiable polyurethane in nonwoven fabric composed of ultra-fine fibers with a mean single fiber fineness at or above 0.001 dtex and at or below 0.5 dtex wherein the ultra-fine fibers and the self-emulsifiable polyurethane essentially do not adhere closely to each other, the self-emulsifiable polyurethane portion has a non-porous structure and a cross-linking structure is present from siloxane bonds in the molecular structure of the self-emulsifiable polyurethane.

Furthermore, the manufacturing method for the leather-like sheet material of this invention which achieves the above-described objective is a leather-like sheet material manufacturing method devised for this invention as described above and has the following processes in the order of (1) to (3).

(1) A process for preparing a sheet using ultra-fine fiber generating type fibers composed of a combination of high molecular substances of two or more types with different solubilities with respect to an alkaline aqueous solution.

(2) A process for impregnating the sheet prepared in (1) above in an aqueous self-emulsifiable polyurethane dispersion solution and providing the self-emulsifiable polyurethane.

(3) A process for processing the sheet in (2) provided with self-emulsifiable polyurethane in an alkaline aqueous solution which causes the ultra-fine fibers to appear.

According to the leather-like sheet material of this invention and its manufacturing method, it is possible to manufacture a leather-like sheet material with excellent outward appearance, texture, physical properties and which is considerate of the environment, provide its manufacturing method and to produce interior, clothing and industrial materials which use it.

BRIEF DESCRIPTION OF DRAWINGS

FIG. 1 shows a cross-section of the interior of the leather-like sheet material pertaining to this invention observed with a scanning electron microscope (SEM) at 300× magnification and shows the non-porous structure of the self-emulsifiable polyurethane portion and the state of the gaps between the self-emulsifiable polyurethane and the fiber bundles.

FIG. 2 shows a cross-section of the interior of a leather-like sheet material made with conventional technology observed with a scanning electron microscope (SEM) at 300× magnification and shows the closely adhering state of the polyurethane and the fiber bundles.

EXPLANATION OF THE SYMBOLS

Figure 1:
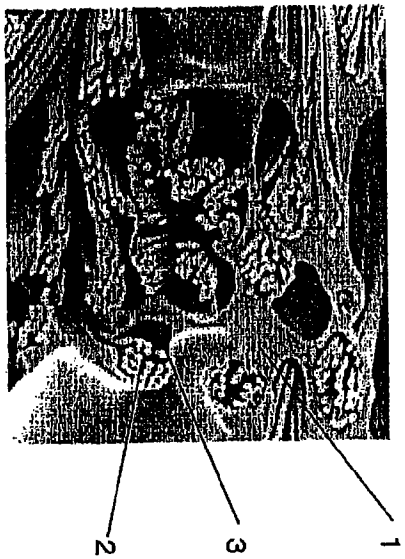
FIG. 1 In order to show an example of the leather-like sheet material of this invention.
Figure 2:
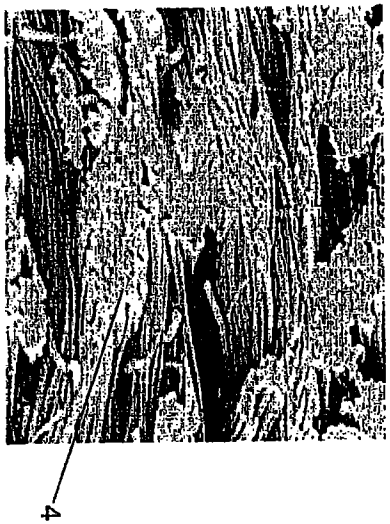
FIG. 2 In order to show an example of a leather-like sheet material of conventional technology.

1. Self-emulsifiable polyurethane
2. Fiber bundles
3. Gap between the self-emulsifiable polyurethane and the fiber bundles
4. State of the close adherence of the polyurethane and fiber bundles

BEST MODE FOR CARRYING OUT THE INVENTION

The leather-like sheet material of this invention is a leather-like sheet material containing self-emulsifiable polyurethane in nonwoven fabric composed of ultra-fine fibers with a mean single fiber fineness at or above 0.001 dtex to at or below 0.5 dtex.

The leather-like sheet material mentioned here has an excellent outer surface appearance of suede, nubuck and grain leather like natural leather and preferably has a smooth touch and outstanding writing effects in the outer appearance of the plush-like nap like suede or nubuck.

As the ultra-fine fibers making up the nonwoven fabric forming the leather-like sheet material of this invention, it is possible to use various types of synthetic fibers with such polyesters as polyethylene terephthalate, polybutylene terephthalate, polytrimethylene terephthalate, polyethylene-2,6-naphthalene dicarboxylate, polyamides such as 6-nylon, 66-nylon, acrylic fibers, polyethylene and polypropylene. Among these, from the viewpoint of strength, dimensional stability, resistance to light and affinity for dyes, it is preferable to use polyester fibers such as polyethylene terephthalate, polybutylene terephthalate, polytrimethylene terephthalate.

As the mean single fiber fineness of the ultra-fine fibers composing the nonwoven fabric, from the viewpoint of sheet suppleness and plush grade, it is necessary to have them at or above 0.001 dtex to at or below 0.5 dtex. At or below 0.3 dtex is preferred and at or below 0.2 dtex is even more preferable. Conversely, from the viewpoint of chromogenic properties after dying or dispersibility of the fibers at nap forming time such as grinding with sandpaper and ease of untangling, at or above 0.005 dtex is preferable.

Furthermore, when the mean single fiber fineness of the ultra-fine fibers constituting the nonwoven fabric exhibits an ultra-fine fiber cross-section that is round or is an elliptical shape close to round, a photograph of the surface of the leather-like sheet material (or nonwoven fabric) is taken with a scanning electron microscope (SEM) at 2000× magnification, 100 of the ultra-fine fibers are selected at random, the fiber diameters are measured, converted to fineness from the specific gravity of the element polymers and the mean value of these 100 fibers is calculated.

Furthermore, when the ultra-fine fibers comprising the nonwoven fabric have an atypical cross-section, in a similar manner the outer round diameter of the atypical cross-section is calculated as the diameter of the fiber. When round cross-sections and atypical cross-sections are mixed, when the mixture contains those with significantly different finenesses, 100 fibers are selected so that there are about the same number of each.

With regard to the uniformity of the fineness of the ultra-fine fibers comprising the nonwoven fabric, it is preferable if the fineness CV in the fiber bundles is equal to or less than 10%. Here, the fineness CV indicates in percentage (%) the value obtained by dividing the standard deviation of the fineness of the fibers comprising the fiber bundles by the mean fineness in the bundles and indicates uniformity when the fineness CV value is small. By having the fineness CV value at or below 10%, it is possible to obtain an excellent product in which the outer appearance of the pile on the surface of the leather-like sheet material of this invention is elegant and in which the dying is homogeneous. The fineness CV when the cross-section of the ultra-fine fibers is not round or elliptically shaped close to round is based on the same method as the calculations for the mean single fiber fineness.

The cross-sectional shape of the ultra-fine fibers may be round but fibers that are elliptical, flat, polygonal such as triangular, flabelliform or cruciform may also be used.

Additionally, the nonwoven fabric may be composed of mixed ultra-fine fibers with different elements. Depending on the item being developed, because there are times when its strength may be low and it cannot be used pursuant to reducing the thickness of the product, with the objective of improving its strength, a structure wherein woven fabric and/or knitted fabric may be inserted in the nonwoven fabric, that is, a structure wherein nonwoven fabric composed of ultra-fine fibers and woven fabric and/or knitted fabric interlaced together is permissible.

The mean single fiber fineness of fibers comprising woven fabric and/or knitted fabric is not particularly limited and may be ultra-fine fibers ranging from 0.001 dtex to 1 dtex.

Here, when ultra-fine fiber nonwoven fabric and woven fabric and/or knitted fabric are interlaced together with a needle punch, they may be cut by the needle depending on the type of yarn in the woven and/or knitted fabric and the strength of the sheet material may decrease and as a measure to prevent this, it is preferable if the type of yarn making up the woven fabric and/or knitted fabric is twisted yarn.

As the twist count of the twisted yarn comprising the woven and/or knitted fabric, because the entwining of the single fibers comprising the yarn is insufficient at under 500 T/m, damage from the needle catching is easily produced making it not desirable while if the twist count is too high, the fibers become too hard making it undesirable from the viewpoint of product texture suppleness so that at or above 500 T/m and at or below 4500 T/m is preferable, at or above 1000 T/m and at or below 4000 T/m is more preferable, between 1500 T/m and 4000 T/m even more preferable and between 2000 T/m and 4000 T/m is most preferable.

It is preferable if twisted yarn (strong twisted yarn) in the above-described twist count range is partially used for the woven fabric and/or knitted fabric and it is particularly preferable from the standpoint of exhibiting high strength if strong twisted yarn is used entirely. Additionally, these strong twisted yarns may also have polyvinyl alcohol and acrylic paste added.

Furthermore, the fineness of the fiber yarn (if it is a multifilaments yarn, it is a total fineness of the filaments) making up the woven and/or knitted fabric is not particularly limited but at or above 200 dtex the weight per unit area of the woven and/or knitted fabric become large with the result that the weight per unit area of the artificial leather looks to be too large and because the stiffness of the woven and/or knitted fabric increases due to this, it becomes difficult to obtain the suppleness that would make it acceptable and desirable as artificial leather. For reasons of stiffness and weight per unit area, it is preferable if the woven and/or knitted fabric is between 30 dtex and 150 dtex and more preferably between 50 dtex and 130 dtex.

Polyester fibers, polyamide fibers, polyethylene fibers or polypropylene fibers or fibers composed of their copolymers are used as fibers composing the woven and/or knitted fabric. Among these, it is preferable if polyester fibers, polyamide fibers and fibers composed of their copolymers are used either singly or in combination.

Furthermore, filament yarn, spun yarn and mixed spun yarn of filaments and staple fibers may be used as the yarn composing the woven fabric and/or knitted fabric. There is no particular limit to their use.

Various types of woven fabrics such as plain weave fabrics, twill weave fabrics, sateen weave fabrics and their weaving methods and various types of knitted fabrics such as lace knits and weft knits represented by warp knitting and tricot knitting and their weaving methods may be used and there is no particular limit to their use.

The nonwoven fabric composing the leather-like sheet material of this invention may be nonwoven fabric comprised of staple fibers or nonwoven fabric comprised of continuous filaments but when considering its texture and the quality of its appearance, nonwoven fabric comprised of staple fibers is preferable. In a similar manner, when considering the texture and the quality of the appearance, it is preferable if the fiber length of the staple fibers is between 25 mm and 90 mm when considering abrasion resistance due to their interlacing.

In this invention, this type of nonwoven fabric is impregnated in a self-emulsifiable polyurethane aqueous dispersion solution as an elastomeric resin binder and the self-emulsifiable polyurethane is present in the interior spaces of the nonwoven fabric.

Here, the self-emulsifiable polyurethane of this invention refers to a polyurethane containing a hydrophilic portion in the molecular structure of the polyurethane which can maintain a state wherein the polyurethane is dispersed by itself in the solution without the use of surfactants in the state of polyurethane aqueous dispersion solution. In the nonwoven fabric pertaining to this invention, the self-emulsifiable polyurethane present in its interior spaces does not substantially adhere to the ultra-fine fibers composing this nonwoven fabric and it is important that this self-emulsifiable polyurethane be of a non-porous structure. That is, because the ultra-fine fibers and the self-emulsifiable polyurethane do not substantially adhere to each other, the self-emulsifiable polyurethane does not inhibit the movement of the ultra-fine fibers and the sheet material is extremely supple.

Here, 'substantially does not adhere' refers to the fact that, when observing a cross-section of the leather-like sheet material with a scanning electron microscope (SEM) at 300× magnification, the self-emulsifiable polyurethane does not combine with the ultra-fine fibers and it can be confirmed that there are spaces present between the self-emulsifiable polyurethane and the ultra-fine fibers. There are some instances where they are partially in contact but basically the state is one in which lacunae are present.

This substantially non-adherence state of the ultra-fine fibers and the self-emulsifiable polyurethane of this invention is one which, after preparing the nonwoven fabric by using ultra-fine fiber generating fibers composed of a combination of high molecular substances of two or more types with different solubilities with respect to an alkaline aqueous solution and impregnating this nonwoven fabric with a self-emulsifiable polyurethane aqueous dispersion solution to impart the self-emulsifiable polyurethane, can be brought to realization due to processing in the alkaline aqueous solution which causes the ultra-fine fibers to appear. Note that the technique in this invention causes lacunae to be present between the ultra-fine fibers in the ultra-fine fiber bundles. However, it is also permissible if a portion is present in which some of the ultra-fine fibers are partially in contact.

Additionally, with the self-emulsifiable polyurethane having a non-porous structure, because the physical strength with respect to, for example, crumpling becomes stronger compared to instances when the structure is porous, the pilling resistance properties and abrasion resistance of the leather-like sheet material turn out to be excellent. The non-porous structure referred to here refers to the fact that, when a photograph of a cross-section of the leather-like sheet material is taken with a scanning electron microscope (SEM) and observed at 300× magnification, pores of 5 μm or larger cannot be seen in the self-emulsifiable portion, that is, their existence cannot be confirmed.

In this manner, the obtained non-porous structure of the self-emulsifiable polyurethane is one that can appear by means of, for example, a method in which the nonwoven fabric is impregnated in the self-emulsifiable polyurethane aqueous dispersion solution or added and solidified by dry heating, a method in which after the nonwoven fabric is impregnated in the self-emulsifiable polyurethane aqueous dispersion solution it is wet heat solidified and dried by heating, and a method in which it is wet processed solidified in hot water and dried by heat and their combinations.

The self-emulsifiable polyurethane present in the interior spaces of the nonwoven fabric is given by impregnating the nonwoven fabric in the self-emulsifiable polyurethane aqueous dispersion solution and this self-emulsifiable polyurethane aqueous dispersion solution is one in which the polyurethane in the polyurethane aqueous dispersion solution is dispersed in a stable manner even without the use of emulsions containing surfactants and is one containing hydrophilic or so-called interior emulsions in the molecular structure of the self-emulsifiable polyurethane.

Furthermore, the self-emulsifiable polyurethane is normally handled in a state where it is dispersed in water and can be obtained in this state from the maker. This is because, once it is dried, it cannot be dispersed in water a second time.

The interior emulsions may be cations of, for example, four classes of amine salts, anions such as sulfonates and carbonates, nonions such as polyethylene glycol, and a combination of cations and nonions or anions and nonions. Most preferable are interior nonion emulsifiers with which there are no concerns about yellowing due to light and no possibility of damage caused by neutralizers.

That is, neutralizers are required when using interior anion emulsifiers, but, for example, when the neutralizers are tertiary amines such as ammonia, triethylamine, triethanolamine, triisopropanolamine, trimethylamine or dimethylethanolamine, amines are produced, volatilized and released to outside the system due to the heat when the membrane is produced and dried. As a result, in order to control the atmospheric release and deterioration of the work environment, it is necessary to install equipment that will recover the volatilized amines. Furthermore, when amines are not volatilized due to the heat and remain in the sheet material which is the finished product, their release into the environment when the product is incinerated may also be taken into consideration. However, because nonion internal emulsifiers do not use neutralizers, it is not necessary to install any amine recovery equipment and there is no concern about any residue remaining in the amine sheet material. Furthermore, when the neutralizers are alkali metal hydroxides such as sodium hydroxide, potassium hydroxide and calcium hydroxide or alkaline earth hydroxides, when the self-emulsifiable polyurethane portion is soaked in water, the alkalinity is exhibited, but because the nonion internal emulsifiers do not use neutralizers, there is no need to worry about deterioration due to hydrolysis of the self-emulsifiable polyurethane.

For the self-emulsifiable polyurethane used in this invention, it is permissible to use one having a structure that can cause polyol, polyisocyanate, elongated chain agents and internal cross-linking agents to react appropriately other than the internal emulsifiers.

As polyols, polycarbonate diols, polyester diols, polyether diols, silicon diols, fluorine diols or their combined copolymers may be used. Among these, from the viewpoint of hydrolysis resistance, it is preferable to use polycarbonate diols and polyether diols, and from the viewpoint of resistance to light and heat, it is even more preferable to use polycarbonate diols.

Polycarbonate diols may be produced from an ester exchange reaction between an alkylene glycol and a carbonic ester or a reaction between phosgene or a chloroformic acid ester and alkylene glycol. As alkylene glycols, straight chain alkylene glycols such as ethylene glycol, propylene glycol, 1,4-butanediol, 1,5-pentanediol, 1,6-hexanediol, 1,9-nonanediol, 1,10-decanediol or branched alkylene glycols such as neopentyl glycol, 3-methyl-1,5-pentanediol, 2,4-diethyl-1,5-pentane diol, 2-methyl-1,8-octane diol, alicyclic family diols such as 1,4-cyclohexane diol, aromatic family diols such as bisphenol A glycerine, trimethylolpropane and pentaerythritol may be cited. Copolymer polycarbonate diols obtained from alkylene glycols of two or more types of polycarbonate diols obtained from various single alkylene glycols may also be used.

As polyisocyanates, such aliphatics as hexamethylene diisocyanate, dicyclohexylmethane diisocyanate, isophorone diisocyanate and xylylene diisocyanate and aromatics such as diphenylmethane diisocyante and tolylene diisocyanate may be cited and it is permissible to use their combinations. Among these, from the viewpoint of resistance to light, aliphatic family members such as hexamethylene diisocyanate, dicyclohexylmethane diisocyanate and isophorone diisocyanate are preferable.

As elongated chain agents, it is permissible to use amine family members such as ethylenediamine and methylenebisanilin, diol family members such as ethylene glycol, and further polyamines obtained from reactions between polyisocyante and water.

The internal cross linking agent is a compound having a functional group capable of a cross-linking reaction which is introduced into the molecular structure beforehand when synthesizing the self-emulsifiable polyurethane as part of the self-emulsifiable polyurethane molecule, and in this invention is a compound used in order to introduce a silanol group into the structure of the self-emulsifiable polyurethane molecule. By introducing a silanol group into the structure of the self-emulsifiable polyurethane molecule, the self-emulsifiable polyurethane present in the interior spaces of the nonwoven fabric has a cross-linking structure because of the siloxane bonds and it is possible to rapidly improve the durability of the hydrolysis resistance of the self-emulsifiable polyurethane.

The compound used in order to introduce a silanol group into the structure of the self-emulsifiable polyurethane molecule is a compound containing at least one isocyanate group, a reactive active hydrogen group, and a hydrolyzable silicon group in one molecule.

The hydrolyzable silicon group refers to a group in which a hydrolyzable group undergoing hydrolysis because of water content is bonded to a silicon atom, and as specific examples of a hydrolyzable group, hydrogen atoms, halogen atoms, alkoxy groups, acyloxy groups, ketoximate groups, amino groups, amide groups, aminooxy groups, mercapto groups and alkenyloxy groups are cited as groups that are generally used. Among these, alkoxy groups which have low hydrolizability and which are comparatively easy to handle are preferable. Hydrolyzable groups bond to one silicon atom in the range of one to three units but because of the reactivity of hydrolyzable silyl groups and water resistance, those with two to three bonds are preferable.

Mercapto groups, hydroxyl groups and amino groups are cited as active hydrogen groups that can react with isocyanate groups.

Compounds containing hydrolyzable silicon groups which have mercapto groups as active hydrogen groups and alkoxly groups as hydrolyzable groups include, for example, Y-mercaptopropyl trimethoxysilane, Y-mercaptopropyl triethoxysilane, Y-mercaptopropyl methyldimethoxysilane and Y-mercaptopropyl methyldiethoxysilane. Compounds containing hydrolyzable silicon groups which have amino groups as active hydrogen groups and alkoxly groups as hydrolyzable groups include, for example, Y-(2-aminoethyl)aminopropyl trimethoxysilane, Y-(2-aminoethyl)aminopropyl triethoxysilane, Y-(2-aminoethyl)aminopropyl dimethoxysilane, Y-(2-aminoethyl)aminopropyl diethoxysilane, Y-aminopropyl trimethoxysilane, Y-aminopropyl triethoxysilane, Y-aminopropyl dimethoxysilane and Y-aminopropyl diethoxysilane. Among these, from the viewpoint of resistance to weather and hydrolysis, introducing a hydrolyzable silicon group in the middle part of the self-emulsifiable polyurethane molecule is preferable and a compound containing a hydrolyzable silicon group which has two or more active hydrogen groups is preferable.

The self-emulsifiable polyurethane with an introduced compound containing a hydrolyzable silicon group has a cross-linking structure because of the siloxane bonds in the state in which they are present in the interior spaces of the nonwoven fabric and it is important that the leather-like sheet material of this invention has a cross-linking structure from the siloxane bonds in the structure of the self-emulsifiable polyurethane molecule. Having this cross-lining structure allows to prevent the polyurethane from separating from the leather-like sheet material.

Here, in order to form the siloxane bonds, it is necessary to condense the silanol groups bonded directly to the polymer. Consequently, the presence of siloxane bonds refers to the condensing of the silanol groups and the cross-linking structure in which bonds are formed between the polymers.

The presence or absence of the siloxane bonds can be verified by the presence or absence of peaks caused by the siloxane bonds in NMR measurements of the polyurethane.

It is preferable if the amount of silicon atoms takes up more than 0% by weight with respect to the weight of the polyurethane and at or below 1% by weight is preferable. This is because a larger cross-linking structure from the siloxane bonds improves the durability of the hydrolysis resistance of the self-emulsifiable polyurethane but when it is more than 1% by weight, the suppleness of the self-emulsifiable polyurethane drops remarkably and the moderate resilient feeling of the sheet material impregnated in the self-emulsifiable polyurethane when holding it in the hand also drops remarkably.

Furthermore, the content of the silicon atoms can be determined through analysis of the sheet material or the elements of the polyurethane extracted from the sheet material.

Additionally, in the production method to be described later, because it is preferable for the self-emulsifiable polyurethane to have heat sensitive gelling properties, it is desirable that polyethylene glycol be present between 3% by weight to 30% by weight with respect to the total weight of the polyurethane. In particular, for self-emulsifiable polyurethane that is self-emulsified by nonion interior emulsions, because if there is too little, self-emulsification becomes difficult and if too much, a decrease in water resistance and a decrease in the physical properties such as the strength of the polyurethane film occur easily, it is preferable for the quantity of the polyethylene glycol with respect to the total weight of the polyurethane to be between 5% by weight and 20% by weight.

In this invention the self-emulsifiable polyurethane may be used singly or as multiple types and other polymers may be used as well.

Other polymers include, for example, water dispersible or water-soluble polymers of the acrylic and silicon family.

Furthermore, it is preferable for the weight reduction rate of the self-emulsifiable polyurethane after it is immersed and cleaned in a sodium hydroxide solution with a concentration of 15 g/L and processed at 90° C. for 30 minutes to be between above 0% by weight and at or below 5% by weight.

Because it is preferable for the weight reduction of the self-emulsifiable polyurethane in the leather-like sheet of this invention from dissolving in an alkaline aqueous solution and separating to be as low as possible, it is preferable for the weight reduction rate to be above 0% by weight and at or below 4% by weight.

Furthermore, as an evaluation of the physical properties of the self-emulsifiable polyurethane here, the weight reduction rate (hydrolysis resistance) from alkaline aqueous solution processing is calculated in the following manner. A produced 10 cm warp×10 cm woof polyethylene fabric (with a warp and woof density respectively at 15 threads/cm and 20 threads/cm) is impregnated in a polyurethane aqueous dispersion solution and dried at 120° C. for 30 minutes and a sheet is obtained with 75% by weight polyurethane with respect to the weight of the fabric. Then, the weight is measured after the obtained sheet is immersed and cleaned in a sodium hydroxide aqueous solution with a density of 15 g/L and processed at 90° C. for 30 minutes and the weight reduction rate is calculated by comparing it with the weight before the immersion and cleaning processing.

The self-emulsifiable polyurethane may contain pigments such as carbon black, dyes, fungicides, antioxidants or light resistance agents such as ultraviolet absorbents, flame retardants, penetrating agents or lubricants, anti-blocking agents such as silica or titanium oxide, surfactants such as anti-static agents, antifoaming agents such as silicon, fillers such as cellulose and solidification conditioners.

In the leather-like sheet material of this invention, it is preferable for the amount of the self-emulsifiable polyurethane with respect to the total substrate weight to be between at or more than 20% by weight to at or below 200% by weight. When at or above 20% by weight, sheet strength is obtained and it is possible to prevent separation of the fibers while at or below 200% by weight the texture is prevented from becoming harder than necessary and it is possible to obtain an excellent targeted plush grade. More preferable is at or above 30% by weight and at or below 180% by weight.

The leather-like sheet material of this invention may contain various types of functional agents as, for example, dyes, pigments, softening agents, texture conditioners, pilling inhibitors, antibacterial agents, deodorizers, water repellants, light resistant agents or weather resistant functional agents.

Next, an explanation will be given about the manufacturing method for the leather-like sheet material of this invention.

The manufacturing method of the leather-like sheet material of this invention is characterized by having the processes in the order of (1)-(3) below.

(1) A process for preparing the sheet using ultra-fine fiber generating fibers composed of a combination of two or more types of high molecular substances with different solubilities with respect to the alkaline aqueous solution.

(2) A process in which self-emulsifiable polyurethane is provided by impregnating the sheet prepared in (1) above in a self-emulsifiable polyurethane aqueous dispersion solution.

(3) A process in which the sheet of (2) above provided with self-emulsifiable polyurethane is processed in an alkaline aqueous solution causing the ultra-fine fibers to appear.

By implementing the process of (1) to (3) in this order, the self-emulsifiable polyurethane ultra-fine fibers form a structure in which they do not substantially adhere to each other and it allows to obtain an extremely supple leather-like sheet material.

Furthermore, when obtaining a leather-like sheet material in which woven fabric and/or knitted fabric is interlaced, process (1) above may be prepared or in particular more specifically a sheet in which woven fabric and/or knitted fabric is interlaced in nonwoven fabric with ultra-fine fiber generating fibers composed of a combination of two or more types of high molecular substances with different solubilities with respect to an alkaline aqueous solution may be prepared.

As a means for obtaining ultra-fine fibers composing the nonwoven fabric, ultra-fine fiber generating fibers are used. By carrying out the ultra-fine processing of the fibers after interlacing the ultra-fine fiber generating fibers beforehand and forming the nonwoven fabric, it is possible to obtain nonwoven fabric with ultra-fine fibers interlaced.

As ultra-fine fiber generating fibers, sea-island type conjugate fibers or peeling type conjugated fibers can be adopted, the sea-island type conjugated fibers wherein the two or more types of thermoplastic high molecular components with different solubilities with respect to an alkaline aqueous solution may be considered as a sea component and an island component, and the island component becomes ultra-fine fibers by dissolving and removing the sea component using an alkaline aqueous solution, or the peeling type conjugated fiber, wherein by positioning the thermoplastic high molecular molecules of the two components in an alternately radial or multiple layer cross-section and stripping and separating all the components, it is possible to use the peeling type conjugated fibers woven separately in the ultra-fine fibers. Here, by removing the sea component, because it is possible to form and furnish appropriate spaces between the island component fibers, that is, it is possible to form and provide suitable spaces between the ultra-fine fibers in the fiber bundles, a desirable condition is created from the viewpoint of material suppleness and texture.

In manufacturing the sea-island type conjugated fibers, they may be produced by using a high molecular arrangement method, which uses a spinneret for the sea-island type conjugate and spins the two components of the sea component and island components in an alternate arrangement or by using a mixed spinning method in which the sea components and island components are spun mixed together but from the viewpoint of obtaining ultra-fine fibers with a uniformity of fineness, it is preferable to have the sea-island type conjugated fibers manufactured by the high molecular arrangement method.

"Different solubilities with respect to an alkaline aqueous solution" in this invention refers to the fact that the rate of dissolution differs by more than 20 times and more preferably differs by more than 40 times under the conditions in which the ultra-fine fibers are caused to appear. If they are less than 20 times, it is difficult to control the fineness of the thermoplastic high molecular component with low solubility when the ultra-fine fibers are caused to appear rendering it undesirable.

Furthermore, the rate of dissolution with respect to an alkaline aqueous solution can be calculated from the weight ratios obtained in accordance with the chemical resistance test (test liquid: 10% sodium hydroxide) in the JIS K6911 Method (1995) with a one hour processing time.

As the sea component in the sea-island type conjugated fibers with high solubility with respect to an alkaline aqueous solution, from the viewpoint of rate of dissolution and spinning stability with regard to the alkaline aqueous solution, it is permissible to use copolyesters or polylactic acid which copolymerize 5-sulfoisophthalate sodium, polyethylene glycol, sodium dodecylbenzene sulfonic acid, bisphenol A compounds, isophthalic acid, adipic acid, dodecadion acid and cylcohexyl carboxylic acid in polyesters such as polyethylene terephthalate, polybutylene terephthalate at 5-12 mol %. With regard in particular to thermal resistance and solubility in a weak alkaline aqueous solution, it is preferable to use polyethylene terephthalate copolymers or polylactic acid to copolymerize 5-sulfoisophthalate sodium at 5-12 mol %. Additionally, these copolymers may not only be 2 component but may be also be three or more multicomponent copolymers.

It is preferable for the obtained ultra-fine fiber generating fibers to undergo a crimping process and be cut a predetermined length when obtaining the unprocessed raw stock of nonwoven fabric. Conventional methods for the crimping and cutting processes can be used. The obtained raw stock is webbed by a cross lapper and then the fibers are interlaced to produce the nonwoven fabric.

As methods for obtaining the nonwoven fabric with interlaced fibers, it is permissible to use conventional methods such as with a needle punch or a waterjet punch or their combination. Furthermore, when interlacing woven fabric and/or knitted fabric together in the nonwoven fabric, it is possible to interlace them together by layering the nonwoven fabric with the ultra-fine fiber generating fibers with the woven fabric and/or the knitted fabric and by carrying out the interlacing process using a needle punch or a waterjet punch or by a combination of them.

As a layering method for the woven fabric and/or knitted fabric, a method wherein the woven fabric and/or knitted fabric is layered and interlaced on both sides or on one side of the nonwoven fabric with the ultra-fine fiber generating fibers or a method wherein, after processing by layering and interlacing on one side, the interlaced material is superimposed a plurality of times, reinterlaced and sliced in after processing may be used.

As woven fabric and/or knitted fabric, it is preferable to use woven fabric and/or knitted fabric that has twisted yarn which the number of twists is at or above 500 T/m and at or below 4500 T/m or at least partially as weaving yarn or knitting yarn.

In making the texture of the product more supple, it is preferable if the woven fabric and/or the knitted fabric in the sheet material is composed of ultra-fine fibers and when it is, it is made extra fine after the twisting process is carried out for the ultra-fine fiber generating fibers and the woven fabric and/or knitted fabric composed of these ultra-fine fiber generating fibers are interlaced together with nonwoven fabric. That is, when interlacing with the nonwoven fabric, it is preferable if the fibers comprising the woven fabric and/or knitted fabric are ultra-fine fiber generating fibers formed by the alkaline soluble polymers as the removed component, polyesters, polyamides, polyethylene, polypropylene as the ultra-fine fiber components, and their copolymers. The cross section shape of ultra-fine fiber generating fibers is not limited. When the nonwoven fabric with ultra-fine fiber generating fibers forming the napped-fibers and the woven fabric and/or knitted fabric composed of ultra-fine fiber generating fibers with the alkaline soluble polymers as the removed portion are interlaced, after processing with the alkaline aqueous solution, the two types of ultra-fine fiber generating fibers are made extra fine simultaneously and their supple effects become more enhanced making this process particularly desirous.

As described above, in the fibers comprising the woven fabric and/or knitted fabric it is preferable for the ultra-fine fibers, that is, the mean single fiber fineness of a single fiber, to have a range at or above 0.001 dtex to at or below 1 dtex, even more preferable is at or above 0.005 dtex to at or below 0.5 dtex and even more preferable at or above 0.005 dtex to at or below 0.3 dtex. Furthermore, it is preferable if the fineness of the composing yarn is at or above 7.5 dtex to at or below 200 dtex and more preferable at or above 20 dtex to at or below 120 dtex. When the single fiber fineness is less than 0.001 dtex, this is preferable from a product suppleness point of view but makes it difficult for strength to be present and when exceeding 1 dtex, a reverse trend occurs. Furthermore, when the composing yarn is less than 7.5 dtex, it is easy to introduce wrinkles at layering time with the nonwoven fabric and when exceeding 200 dtex, interlacing with the nonwoven fabric is insufficient and peeling easily occurs making this undesirable.

By forming a structure interlacing the nonwoven fabric of ultra-fine fiber generating fibers with woven fabric and/or knitted, because the woven fabric and/or knitted fabric is greatly shrunk in a shrinking process and the density of the sheet goes up, the surface quality of the products is rapidly enhanced.

In order to further improve the feeling of fineness in the obtained nonwoven fabric, shrinking process may be carried out by processing with hot water or steam.

Additionally, before impregnation in the self-emulsifiable polyurethane aqueous dispersion solution, the nonwoven fabric may be obtained by cutting it in half in the direction of the thickness of the nonwoven fabric (sliced and divided into two pieces) or may be divided into a number of pieces.

It is preferable for the sheet material in which nonwoven fabric composed of ultra-fine fibers interlaced with woven fabric and/or in this invention to have a strength of 10 N/cm or more when stretched 10% both lengthwise and widthwise. When less than 10 cN/cm, the strength is too low and its ability to last in practical use is severely compromised and it is preferable if the range is 12 cN/cm or greater with an upper limit of approximately 60 cN/cm.

Methods for adding the self-emulsifiable polyurethane aqueous dispersion solution to the nonwoven fabric include a method for impregnating the nonwoven fabric in the polyurethane aqueous dispersion solution or adding it and using dry heat to solidify, a method wherein after the nonwoven fabric is impregnated in the polyurethane aqueous dispersion solution it is solidified by wet heat and dried by heating, and a method wherein it is wet process solidified in hot water and dried by heating and their combinations but they are not particularly limited to these.

Furthermore, because, when the dry heat temperature is too low, drying time is protracted and when too high, the likelihood exists that deterioration of the self-emulsifiable polyurethane by heat may occur, at or above 80° C. to at or below 180° C. is preferred. Even more preferable is at or above 90° C. to at or below 160° C.

When solidifying in hot water, if the temperature of the hot water is above the solidifying temperature of the polyurethane aqueous dispersion solution, any ° C. temperature is permissible and, for example, it is preferable if it is at or above 50° C. to at or below 100° C.

The polyurethane aqueous dispersion solution used in manufacturing the leather-like sheet of this invention is any polyurethane aqueous dispersion solution considered to be an emulsion dispersed in water and is a self-emulsifiable polyurethane aqueous dispersion solution that contains no emulsifiers such as surfactants.

When using a forcibly emulsified type polyurethane aqueous dispersion solution that contains emulsifiers such as surfactants, because tackiness caused by the emulsifier occurs on the surface of the obtained leather-like sheet material, a cleaning process is required, the manufacturing process increases and costs go up. Additionally, because, in a forced emulsified type polyurethane aqueous dispersion solution, the water resistance of the polyurethane coating which has been formed drops due to the presence of emulsifiers, sloughing off of the polyurethane into the dyeing solution occurs in the dyeing of the sheet material containing polyurethane and this is not desirous.

The polyurethane aqueous solution used in this invention is a self-emulsifiable polyurethane aqueous dispersion solution and this self-emulsifiable polyurethane aqueous solution is one that is stable even without using emulsifiers such as surfactants and has hydrophilic or so-called internal emulsifiers in the structure of the self-emulsifiable polyurethane molecule.

Furthermore, the self-emulsifiable polyurethane is handled in a state in which it is dispersed in water and may be obtained in this state from the maker. This is because it cannot be dispersed in water a second time once it is dried.

The self-emulsifiable polyurethane aqueous dispersion solution used in this invention may contain water-soluble organic solvents between above 0% by weight to at or below 40% by weight with respect to the aqueous dispersion solution in order to improve storage stability or coating properties. But because of concerns about release of the organic solvents into the atmosphere due to heating at coating time or any remaining residue of the organic solvents in the finished product, it is preferable if no organic solvents are included or included only in the range of above 0% by weight to at or below 1% by weight and even more preferable if no organic solvents are included at all.

The aqueous dispersion solution may be one in which the self-emulsifiable polyurethane is dispersed in water but it is not limited to this and from the standpoint of water resistance degradability, it is preferable if the solution is a polycarbonate family self-emulsifiable polyurethane aqueous dispersion solution.

Furthermore, the self-emulsifiable polyurethane aqueous dispersion solution is a self-emulsifiable polyurethane aqueous dispersion (described below as a self-emulsifiable polyurethane containing silanol) which contains at least one silanol group in the structure of the self-emulsifiable polyurethane molecule. By containing silanol groups, the silanol groups condense when the coating is made, a cross-linking structure from the siloxane bonds is formed and the alkali-proof hydrolyzability of the polyurethane improves rapidly.

Silanol groups in self-emulsifiable polyurethane containing silanol groups are formed by having a hydrolyzable silicon group in a compound containing at least one isocyanate group, a reactive active hydrogen group, and the hydrolyzable silicon group in one molecule used in the reaction hydrolyze in water. Because of the presence of sufficient water in the surroundings, the silanol group in the self-emulsifiable polyurethane containing this silanol does not reach a phase in which the silanol groups react and form siloxane bonds and is thus present in a stable form in water.

The silanol groups contained in the self-emulsifiable polyurethane containing silanol groups may be bonded either at one of the two ends or in the middle portion of the self-emulsifiable polyurethane molecule containing the silanol groups, or may be bonded to both. However, because the cross-linking structure produces an effect on the water resistance and the physical properties of the self-emulsifiable polyurethane after the coating is made, it is preferable if the silanol group is contained in the middle portion of the self-emulsifiable polyurethane molecules containing the silanol groups.

It is preferable if the concentration of the self-emulsifiable polyurethane aqueous dispersion solution (the amount of the self-emulsifiable polyurethane with respect to the self-emulsifiable polyurethane aqueous dispersion solution) is at or above 10% by weight and at or below 50% by weight from the standpoint of the storage stability of the self-emulsifiable polyurethane aqueous dispersion solution and suppression of the migration phenomenon after the sheet is impregnated and dried.

Additionally, it is preferable for the self-emulsifiable polyurethane aqueous dispersion solution to have a heat sensitive gelling temperature. By using one that has this heat sensitive gelling temperature, it is possible to suppress the migration phenomenon of the polyurethane after the sheet is impregnated and dried. However, because the likelihood is high that the polyurethane will gel if the heat sensitive gelling temperature is too low when the polyurethane aqueous dispersion solution is stored and because if it is too high it is difficult to suppress the migration phenomenon, it is preferable if the temperature is at or above 55° C. to at or below 90° C.

It is preferable if the self-emulsifiable polyurethane aqueous solution is one that independently has heat sensitive gelling properties and with the objective of conferring heat sensitive gelling properties to the self-emulsifiable polyurethane aqueous solution or decreasing the heat sensitive gelling temperature, inorganic salts such as calcium chloride, sodium sulfate or potassium sulfate may be added.

Furthermore, when adding to the self-emulsifiable polyurethane aqueous dispersion solution, depending on need, pigments such as carbon black, dyes, fungicides, fade resisting agents such as anti-oxidants or ultraviolet absorbing agents, fire retardants, penetrating agents, lubricants, anti-blocking agents such as silica or titanium oxide, anti-static agents, anti-foaming agents such as silicon, fillers such as cellulose and polyurethane solidification conditioners may be used and added.

With the leather-like sheet material of this invention, ultra-fine fibers can be caused to appear through processing with an alkaline aqueous solution after self-emulsifiable polyurethane has been added to a sheet composed of ultra-fine fiber generating fibers.

There is no particular limit to the alkaline aqueous solution but aqueous solutions of, for example, sodium hydroxide and calcium hydroxide and ammonium salts may be used.

The density of the alkaline aqueous solution is not particularly limited as long as ultra-fine fibers appear but it is preferable if it is at or above 0.05 mol/L to at or below 10 mol/L.

Processing with the alkaline aqueous solution involves soaking and squeezing the sheet composed of ultra-fine fiber generating fibers after the self-emulsifiable polyurethane is added. For peeling type conjugated fibers it is processing in which they are separated by alkaline aqueous solution processing and by physical force from, for example, the effects of rubbing causing the ultra-fine fibers to appear while for the sea-island type conjugated fibers it is processing in which the sea component is eluted out which causes the ultra-fine fibers to appear, but it is not limited to these methods and, for example may be processing using a jet dyeing machine or purifying equipment and their combinations.

For the temperature and time in the processing using a jet dyeing machine, it is preferable if they are respectively at or above 50° C. to at or below 140° C. for between 5 minutes and 90 minutes.

Furthermore, with the objective of improving efficiency in appearing the ultra-fine fibers, processing may be conducted in which appropriate heating processing or steam processing and processing adding penetrating agents such as surfactants are carried out and processing may also be carried out in an acidic aqueous solution with a pH of three or less after processing has been done with the alkaline aqueous solution beforehand.

The leather-like sheet material of this invention may also be leather-like sheet material with a plush-like condition that has the napped fibers on at least one side of the sheet material The nap raising processing to form the napped fibers on both surfaces of the leather-like sheet material may be carried out by an abrasion method using sandpaper or a roller sander. A lubricant such as a silicon emulsion may also be added before the nap raising processing.

Additionally, it is preferable that an antistatic agent be added before the nap raising processing to make it difficult for the ground particles produced from the leather-like sheet material from the grinding to adhere to the sandpaper.

Furthermore, before carrying out the nap raising processing, the leather-like sheet material may be obtained by cutting it in half in the direction of the thickness of the sheet (sliced and divided into two pieces) or may be divided and cut into a number of pieces.

The leather-like sheet material of this invention may also be dyed. When dyeing the leather-like sheet material, because it is possible to introduce a crumpling effect and make the sheet material supple at the same time the leather-like sheet material is dyed, it is preferable to use a jet dyeing machine. A conventional jet dyeing machine may be used.

If the dyeing temperature is too high, the self-emulsifiable polyurethane may deteriorate and, conversely, if too low, the fibers may be insufficiently dyed so that temperature changes due to the types of fibers are permissible. Generally it is preferable if the dyeing temperature is at or above 80° C. to at or below 150° C. and even more preferably at or above 110° C. to at or below 130° C.

There is no particular limit to the dyes that can be used but they can be used depending on the ultra-fine fibers making up the nonwoven fabric. If, for example, they are polyester family ultra-fine fibers, disperse dyes may be used and if polyamide family ultra-fine fibers, dyes such as acidic dyes or metallic dyes may be used. Their combinations may also be used.

When dyeing with disperse dyes, reduction cleaning may be carried out after dyeing.

Furthermore, dyeing auxiliaries may be preferable when dyeing with the objective of improving the uniformity and reproduction of the dyes. Additionally, finishing agent processing may also be carried out with softening agents such as silicon, antistatic agents, water repellent preparations, flame retardants, light resistant agents and the finishing agent processing may also be carried out in the same bath with the dyeing even after dyeing.

The leather-like sheet material of this invention may be suitably used in interior materials having an extremely elegant outer appearance such as for furniture, chairs and wall-finishing materials or for seats, ceilings and interiors in automobiles, trains and aircraft, in clothing materials used or used in parts, for example, for shirts, jackets and the upper part and trim of, for example, casual shoes, sport shoes, dress shoes and women's shoes and for briefcases, belts and wallets, and in industrial materials such as wiping cloths and abrasive cloths.

EXAMPLES

A more specific explanation of this invention using examples is given below but this invention is not limited to only the following cited examples.

Evaluation Method (1) Mean Single Fiber Fineness

A photograph was taken of the nonwoven fabric or the surface of the leather-like sheet material with a scanning electron microscope (SEM) at 2000× magnification and 100 fibers which are round or an elliptical shape close to round were randomly selected, their diameters were measured and converted to fineness from the specific gravity of the material polymers of the fibers and the fineness calculated by calculating the mean value of the 100 fibers.

(2) Fineness CV

A photograph of the nonwoven fabric or an interior cross-section of the leather-like sheet material was taken by a scanning electron microscope (SEM) at 2000× magnification and from this photograph the fiber diameters of the ultra-fine fibers making up one bundle of the bundled fibers were measured, converted to fineness for each single fiber from the fiber diameters, the fineness standard deviation of the fibers comprising the fiber bundles was divided by the mean fineness in the bundles and the value expressed as a percentage (%). Five of the bundled fibers were measured in this manner and their mean value taken as the fineness CV.

(3) Structure of the Leather-Like Sheet Material

A photograph of a cross-section of the interior of the leather-like sheet material was taken with a scanning electron microscope (SEM) at 300× magnification and from this photograph and the state of the adherence of the ultra-fine fibers with the polyurethane and the structure of the polyurethane part was determined.

(4) Verification of the Siloxane Bonds and Determination of the Quantity of Silicon Atoms Contained With regard to the polyurethane sampled from more than three random locations in the sheet material, they were variously measured by NMR and by verifying the peaks that would be caused by siloxane bonds in any of the location measurements, the presence or absence of the siloxane bonds was confirmed. Furthermore, by conducting an elemental analysis of the sheet material or the polyurethane extracted from the sheet material more than 5 times, the quantity of the silicon atoms was determined.

(5) Verification of Polyethylene Glycol

With regard to the polyurethane in which more than 3 locations in the sheet material were randomly sampled, in the various measurements by NMR, calculations were made and averaged by comparing the area of the peaks caused by the reference material with the area of the peaks (for example, the protons of the ethylene chain parts near the oxygen atoms) caused by polyethylene glycol.

(6) Heat Sensitive Gelling Temperature of the Polyurethane Aqueous Dispersion Solution Ten grams of a polyurethane aqueous solution with a solid density of 10% by weight were placed in a test tube, the temperature was raised in a constant temperature hydrothermal solution of 95° C. and the heat sensitive gelling temperature was taken to be the temperature when the polyurethane aqueous solution lost its liquidity and gelled and solidified. Measurements were taken more than a total of 2 times and averaged.

(7) Amount of Organic Solvent Contained in the Polyurethane Aqueous Dispersion Solution In the polyurethane aqueous dispersion solution with the solid density used in the impregnation, the amount of organic solvents was determined by gas chromatography analysis of the dispersion medium (Hitachi model No. 263-50, columns: different depending on the type of organic solvents but for N,N-dimethylformamide, a PEG20M was used). Measurements for a total of more than two times were taken and averaged.

(8) Anti-Hydrolyzing Properties of the Polyurethane (Weight Reduction Rate)

By impregnating a 10 cm×10 cm polyethylene woven fabric (with a density of 15 yarns/cm lengthwise and 20 yarns/cm widthwise) in a polyurethane aqueous dispersion solution and drying it at 120° C. for 30 minutes, a sheet was obtained with 75% by weight polyurethane provided with respect to the weight of the woven fabric.

Next, the obtained sheet was soaked in a sodium hydroxide aqueous solution with a concentration of 15 g/L, the weight was measured after processing for 30 minutes at 90° C., a comparison was made with the weight before the soaking processing and the weight reduction rate calculated. More than two measurements were taken and averaged.

(9) Quality of the Outer Appearance

The surface quality of the leather-like sheet material was evaluated as described below by visible observation and by sensory evaluation. An acceptable level was marked with a [○].

○: Napped fiber length and fiber dispersion state both excellent.

Δ: Napped fiber length excellent but dispersion state unacceptable.

X: Almost no napped fiber, unacceptable.

(10) Pilling Evaluation

The pilling evaluation of the leather-like sheet material was done using a James H. Heal & Co. Model 406 as a Martindale abrasion tester and their Abrasive Cloth SM25 as a standard abrasion cloth and the outer appearance of the test specimen was observed after a applying a considerable load of 12 kPa and rubbing 20,000 times and evaluated. The evaluation standard was to give a 5 when there was absolutely no change compared to before the rubbing and a 1 when there was considerable pill generated and the numbers were divided into 0.5 increments. A total of more than two measurements were made and evaluated. Furthermore, the acceptable level was taken to be 4 and above.

(11) Texture

With 10 healthy adult males and 10 healthy adult females for a total of 20 persons as evaluators, discrimination by the sense of touch was carried out to make the evaluation given below and most of the evaluations were for the texture. The acceptable level was considered to be [○]

○: Extremely supple and an appropriate feeling of resilience.

Δ: Supple but no feeling of resilience. Or some feeling of resilience but hard.

X: Hard and no feeling of resistance.

(12) Measurement of the Tensile Strength of the Sheet Material

Based on the measurement method for tensile strength and elongation percentage of 8.12.1 of JIS-L1096 (revised in 1990, verified in 2004), the strength (N/cm) was measured in a 10% extension rate.

List of Chemicals

The meanings of the abbreviations of the chemicals used in embodiments and the comparative examples are as follows:

C5C6PC: a copolymer polycarbonate polyol of pentamethylene carbonate diol and hexamethylene carbonate diol 3MPC: poly(3-methylpentane carbonate)polyol PHC: polyhexamethylene carbonate diol IPDI: isophorone diisocyanate H12MDI: dicyclohexylmethane diisocyanate HDI: hexamethylene diisocyanate MDI: diphenylmethane diisocyanate PET: polyethylene terephthalate Ny6: 6-nylon PEG: polyethylene glycol PBT: polybutylene terephthalate Types of Polyurethane The composition of the polyurethane aqueous dispersion solution used in the embodiments and the comparative examples is given below. Also, the solid concentration in each solution is 30% by weight. Furthermore, the characteristics of each polyurethane are shown in Table 1.

(1) Self-emulsifiable Polyurethane Aqueous Dispersion Solution 1 (PU-1)

Polyisocyanate: IPDI

Polyol: C5C6PC

Internal emulsifier: diol compounds having polyethylene glycol in the side chains Chain elongating agent: water (diamine obtained from the reaction of isocyanate with water)

Internal cross linking agent: Y-(2-aminoethyl)aminopropyl trimethoxysilane

Organic solvent contained: 0.05% by weight (2) Self-Emulsifiable Polyurethane Aqueous Dispersion Solution 2 (PU-2)

Polyisocyanate: IPDI

Polyol: C5C6PC

Internal emulsifier: diol compounds having polyethylene glycol in the side chains Chain elongating agent: water (diamine obtained from the reaction of isocyanate with water)

Internal cross linking agent: Y-(2-aminoethyl)aminopropyl trimethoxysilane

Organic solvent contained: 0.06% by weight (3) Self-Emulsifiable Polyurethane Aqueous Dispersion Solution 3 (PU-3)

Polyisocyanate: H12MDI

Polyol: C5C6PC

Internal emulsifier: diol compounds having polyethylene glycol in the side chains Chain elongating agent: water (diamine obtained from the reaction of isocyanate with water)

Internal cross linking agent: Y-(2-aminoethyl)aminopropyl trimethoxysilane

Organic solvent contained: 0.05% by weight (4) Self-Emulsifiable Polyurethane Aqueous Dispersion Solution 4 (PU-4)

Polyisocyanate: HDI

Polyol: C5C6PC

Internal emulsifier: diol compounds having polyethylene glycol in the side chains Chain elongating agent: water (diamine obtained from the reaction of isocyanate with water)

Internal cross linking agent: Y-(2-aminoethyl)aminopropyl trimethoxysilane

Organic solvent contained: 0.04% by weight (5) Self-Emulsifiable Polyurethane Aqueous Dispersion Solution 5 (PU-5)

Polyisocyanate: IPDI

Polyol: C5C6PC

Internal emulsifier: dimethylol propionic acid triethylamine salt

Chain elongating agent: water (diamine obtained from the reaction of isocyanate with water)

Internal cross linking agent: Y-(2-aminoethyl)aminopropyl trimethoxysilane

Organic solvent contained: 0.05% by weight (6) Self-Emulsifiable Polyurethane Aqueous Dispersion Solution 6 and 8 (PU-6 and PU-8)

Polyisocyanate: HDI

Polyol: 3MPC

Internal emulsifier: diol compounds having polyethylene glycol in the side chains Chain elongating agent: water (diamine obtained from the reaction of isocyanate with water)

Internal cross linking agent: Y-(2-aminoethyl)aminopropyl trimethoxysilane

Organic solvent contained: 0.06% by weight (7) Self-Emulsifiable Polyurethane Aqueous Dispersion Solution 7 and 9 (PU-7 and PU-9)

Polyisocyanate: HDI

Polyol: 3MPC

Internal emulsifier: dimethylol propionic acid triethylamine salt

Chain elongating agent: water (diamine obtained from the reaction of isocyanate with water)

Internal cross linking agent: Y-(2-aminoethyl)aminopropyl trimethoxysilane

Organic solvent contained: 0.08% by weight (8) Self-Emulsifiable Polyurethane Aqueous Dispersion Solution 10 (PU-10)

Polyisocyanate: HDI

Polyol: 3MPC

Internal emulsifier: diol compounds having polyethylene glycol in the side chains Chain elongating agent: water (diamine obtained from the reaction of isocyanate with water)

Internal cross linking agent: none

Organic solvent contained: 0.07% by weight (9) Self-Emulsifiable Polyurethane Aqueous Dispersion Solution 11 (PU-11)

Polyisocyanate: HDI

Polyol: 3MPC

Internal emulsifier: dimethylol propionic acid triethylamine salt

Chain elongating agent: water (diamine obtained from the reaction of isocyanate with water)

Internal cross linking agent: none

Organic solvent contained: 0.09% by weight

(10) Solvent System Polyurethane 12 (PU-12)

Polyisocyanate: MDI

Polyol: PHC

Internal emulsifier: none

Chain elongating agent: water (diamine obtained from the reaction of isocyanate with water)

Internal cross linking agent: none

Organic solvent contained: 100% by weight (solvent N, N-dimethylformamide)

(11) Forcibly Emulsified Polyurethane 13 (PU-13)

Polyisocyanate: H12MDI

Polyol: PHC

Internal emulsifier: none

External emulsifier: nonion family surfactants
Internal cross linking agent: none
Organic solvent contained: 0.09% by weight

(12) Self-Emulsifiable Polyurethane Aqueous Dispersion Solution 14 (PU-14)
Polyisocyanate: H12MDI
Polyol: C5C6PC
Internal emulsifier: diol compounds having polyethylene glycol in the side chains
Chain elongating agent: water (diamine obtained from the reaction of isocyanate with water)
Internal cross linking agent: Y-(2-aminoethyl)aminopropyl trimethoxysilane
Organic solvent contained: 0.05% by weight

(13) Self-Emulsifiable Polyurethane Aqueous Dispersion Solution 15 (PU-15)
Polyisocyanate: HDI
Polyol: C5C6PC
Internal emulsifier: diol compounds having polyethylene glycol in the side chains
Chain elongating agent: water (diamine obtained from the reaction of isocyanate with water)
Internal cross linking agent: Y-(2-aminoethyl)aminopropyl trimethoxysilane
Organic solvent contained: 0.04% by weight

(14) Self-Emulsifiable Polyurethane Aqueous Dispersion Solution 16 (PU-16)
Polyisocyanate: HDI
Polyol: C5C6PC
Internal emulsifier: dimethylol propionic acid triethylamine salt
Chain elongating agent: water (diamine obtained from the reaction of isocyanate with water)
Internal cross linking agent: Y-(2-aminoethyl)aminopropyl trimethoxysilane
Organic solvent contained: 0.05% by weight

(15) Self-Emulsifiable Polyurethane Aqueous Dispersion Solution 17 and 19 (PU-17 and PU-19)
Polyisocyante: HDI
Polyol: 3MPC
Internal emulsifier: diol compounds having polyethylene glycol in the side chains
Chain elongating agent: water (diamine obtained from the reaction of isocyanate with water)
Internal cross linking agent: Y-(2-aminoethyl)aminopropyl trimethoxysilane
Organic solvent contained: 0.06% by weight

(16) Self-Emulsifiable Polyurethane Aqueous Dispersion Solution 18 and 20 (PU-18 and PU-20)
Polyisocyanate: HDI
Polyol: 3MPC
Internal emulsifier: dimethylol propionic acid triethylamine salt
Chain elongating agent: water (diamine obtained from the reaction of isocyanate with water)
Internal cross linking agent: Y-(2-aminoethyl)aminopropyl trimethoxysilane
Organic solvent contained: 0.05% by weight

(17) Self-Emulsifiable Polyurethane Aqueous Dispersion Solution 21 (PU-21)
Polyisocyanate: HDI
Polyol: 3MPC
Internal emulsifier: diol compounds having polyethylene glycol in the side chains
Chain elongating agent: water (diamine obtained from the reaction of isocyanate with water)
Internal cross linking agent: none
Organic solvent contained: 0.07% by weight

(18) Self-Emulsifiable Polyurethane Aqueous Dispersion Solution 22 (PU-22)
Polyisocyanate: HDI
Polyol: 3MPC
Internal emulsifier: dimethylol propionic acid triethylamine salt
Chain elongating agent: water (diamine obtained from the reaction of isocyanate with water)
Internal cross linking agent: none
Organic solvent contained: 0.09% by weight

(19) Solvent System Polyurethane 23 (PU-23)
Polyisocyanate: MDI
Polyol: PHC
Internal emulsifier: none
Chain elongating agent: water (diamine obtained from the reaction of isocyanate with water)
Internal cross linking agent: none
Organic solvent contained: 100% by weight (solvent N,N-dimethylformamide)

(20) Forcibly Emulsified Polyurethane 24 (PU-24)
Polyisocyanate: HDI
Polyol: PHC
Internal emulsifier: none
Internal cross linking agent: none
Organic solvent contained: 0.09% by weight

Example 1

Using sea-island type staple fibers (fiber length 51 mm) with a proportion composed of 45 parts of polyethylene terephthalate copolymerized with 8 mol % 5-sulfoisophthalate sodium as the sea component and 55 parts of PET as the island component, a state was produced with 36 island components in one filament of a mean fineness of 2.8 dtex, a web was formed by means of a card and cross wrapper and the nonwoven fabric produced by means of needle punch processing.

This nonwoven fabric was processed and shrunk for 2 minutes in a 90° C. hot water bath and dried for 5 minutes at 100° C. Next, by impregnating it in the self-emulsifiable polyurethane aqueous dispersion solution 1 (PU-1) and hot air drying it for 10 minutes at a drying temperature of 125° C., a sheet was obtained in which the weight of the polyurethane was 80% by weight with respect to the island component weight of the nonwoven fabric.

Next, a processing was carried out for 30 minutes by soaking this sheet in a sodium hydroxide solution with a density of 15 g/L heated to 90° C. and a sea-less fiber sheet was obtained by removing the sea components of the sea-island type fibers. By observing the surface of the sea-less fiber sheet with a scanning electron microscope (SEM), it was verified that the mean single fiber fineness was 0.04 dtex and the fineness CV was 7.4%.

After nap raising processing was carried out by cutting the sea-less fiber sheet in half in the direction of the thickness and grinding the opposite side of half-cut surface using 240 grit endless sandpaper, dyeing was carried out with disperse dyes using a circular dyeing machine and the leather-like sheet material of this invention was obtained.

The quality of the outer appearance, an evaluation of the pilling and the texture of the obtained leather-like sheet material were all excellent.

Examples 2-6

Except for the respective changes in the self-emuslfiable polyurethane aqueous dispersion solution, processing was carried out in a manner similar to Example 1 and the leather-like sheet materials of this invention were obtained. The quality of the outer appearance, an evaluation of the pilling and the texture of the obtained leather-like sheet materials were all excellent.

Example 7

Using sea-island type staple fibers (fiber length 51 mm) with a proportion composed of 20 parts of polyethylene terephthalate copolymerized with 8 mol % 5-sulfoisophthalate sodium as the sea component and 80 parts of PET as the island component, a state was produced with 16 island components in one filament of a mean fineness of 3.8 dtex, a web was formed by means of a card and cross wrapper and the nonwoven fabric produced by means of needle punch processing.

This nonwoven fabric was processed and shrunk for 2 minutes in a 90° C. hot water bath and dried for 5 minutes at 100° C. Next, by impregnating it in the self-emulsifiable polyurethane aqueous dispersion solution 7 (PU-7) and hot air drying it for 10 minutes at a drying temperature of 125° C., a sheet was obtained in which the weight of the polyurethane was 85% by weight with respect to the weight of the nonwoven fabric.

Next, a processing was carried out for 30 minutes by soaking this sheet in a sodium hydroxide solution with a density of 15 g/L heated to 90° C. and a sea-less fiber sheet was obtained by removing the sea components of the sea-island type fibers. By observing the surface of the sea-less fiber sheet with a scanning electron microscope (SEM), it was verified that the mean single fiber fineness was 0.21 dtex and the fineness CV was 7.8%.

After nap raising processing was carried out by cutting the sea-less fiber sheet in half in the direction of the thickness and grinding the opposite side of half-cut surface using 240 grit endless sandpaper, dyeing was carried out with disperse dyes using a circular dyeing machine and the leather-like sheet material of this invention was obtained.

The quality of the outer appearance, an evaluation of the pilling and the texture of the obtained leather-like sheet material were all excellent.

Example 8

Using sea-island type staple fibers (fiber length 51 mm) with a proportion composed of 20 parts of polylactic acid as the sea component and 80 parts of Ny6 as the island component, a state was produced with 16 island components in one filament of a mean fineness of 3.8 dtex, a web was formed by means of a card and cross wrapper and the nonwoven fabric produced by means of needle punch processing.

This nonwoven fabric was processed and shrunk for 2 minutes in a 90° C. hot water bath and dried for 5 minutes at 100° C. Next, by impregnating it in the self-emulsifiable polyurethane aqueous dispersion solution 8 (PU-8) and hot air drying it for 10 minutes at a drying temperature of 125° C., a sheet was obtained in which the weight of the polyurethane was 85% by weight with respect to the weight of the nonwoven fabric.

Next, a processing was carried out for 30 minutes by soaking this sheet in a sodium hydroxide solution with a density of 40 g/L heated to 90° C. and a sea-less fiber sheet was obtained by removing the sea components of the sea-island type fibers. By observing the surface of the sea-less fiber sheet with a scanning electron microscope (SEM), it was verified that the mean single fiber fineness was 0.2 dtex and the fineness CV was 7.5%.

After nap raising processing was carried out by cutting the sea-less fiber sheet in half in the direction of the thickness and grinding the opposite side of half-cut surface using 240 grit endless sandpaper, dyeing was carried out with disperse dyes using a circular dyeing machine and the leather-like sheet material of this invention was obtained.

The quality of the outer appearance, an evaluation of the pilling and the texture of the obtained leather-like sheet material were all excellent.

Example 9

Except for using PBT in the island component and using the self-emulsifiable polyurethane aqueous dispersion solution 9 (PU-9), processing was carried out in a manner similar to Example 1 and the leather-like sheet material of this invention was obtained. The mean single fiber fineness was 0.04 dtex and the fineness CV was 7.9%. The quality of the outer appearance of the obtained leather-like sheet material, the pilling evaluation and the texture were all excellent.

Comparative Examples 1 and 2

Except for using the various self-emulsifiable polyurethane aqueous dispersion solutions 10 (PU-10) and 11 (PU-11), processing was carried out in a manner similar to Example 1 and the leather-like sheet material of this invention was obtained. The self-emulsifiable aqueous solution 10 (PU-10) was used in comparative example 1 and the self-emulsifiable polyurethane aqueous solution 11 (PU-11) was used in comparative example 2.

The quality of the outer appearance and the texture of the obtained sheets were excellent but the pilling evaluation was 1.

Comparative Example 3

Except for the sheet obtained in Example 1 with polyurethane added so that the weight of the polyurethane was 80% by weight with respect to the weight of the island component of the nonwoven fabric by soaking the nonwoven fabric in a sodium hydroxide solution with a density of 15 g/L, processing for 30 minutes before the polyurethane was added and producing a sea-less nonwoven fabric with the sea component of the sea-island type fibers removed and subsequently impregnating it in the self-emulsifiable polyurethane aqueous dispersion solution 1 (PU-1) and drying it for 10 minutes at a drying temperature of 125° C., a leather-like sheet material was obtained by processing carried out in a manner similar to Example 1.

The obtained leather-like sheet material had a pilling evaluation of 4.5 but the texture was extremely stiff and the quality of the outside appearance with almost no nap was unacceptable.

Comparative Example 4

Except for the sheet obtained in Example 1 with polyurethane added so that the weight of the polyurethane was 80% by weight with respect to the weight of the island component of the nonwoven fabric by soaking the nonwoven fabric in a sodium hydroxide solution with a density of 15 g/L, processing for 30 minutes before the polyurethane was added and producing a sea-less nonwoven fabric with the sea component of the sea-island type fibers removed and subsequently impregnating it in the solvent polyurethane 12 (PU-12) and soaking it in water at 40° C. and wet process solidifying it for 60 minutes, a leather-like sheet material was obtained by processing carried out in a manner similar to Example 1.

The pilling evaluation of the obtained leather-like sheet material was low at 3.5 and the texture was extremely rigid and the quality of the outer appearance with almost no nap was unacceptable.

Comparative Example 5

Except for using the forced emulsified polyurethane aqueous dispersion solution 13 (PU-13), a leather-like sheet material was obtained by processing in a manner similar to Example 1.

The texture of the obtained leather-like sheet material was excellent but the dispersion of the fibers in the quality of the outer appearance was unacceptable and the pilling evaluation was 2.

Example 10

Using sea-island type staple fibers (fiber length 51 mm) with a proportion composed of 45 parts of polyethylene terephthalate copolymerized with 8 mol % 5-sulfoisophthalate sodium as the sea component and 55 parts of PET as the island component, a state was produced with 36 island components in one filament of a mean fineness of 2.8 dtex, a web was formed by means of a card and cross wrapper, a plain weave fabric using strong twisted yarn with a PET 84 dtex-72 filaments and 2000 T/m twist count was layered and interlaced and the nonwoven fabric produced by means of needle punch processing.

This nonwoven fabric was processed and shrunk for 2 minutes in a 90° C. hot water bath and dried for 5 minutes at 100° C. Next, by impregnating it in the self-emulsifiable polyurethane aqueous dispersion solution 14 (PU-14) and, after processing for 5 minutes at a moist heat temperature of 100° C., hot air drying it for 10 minutes at a drying temperature of 125° C., a sheet was obtained in which the weight of the polyurethane was 80% by weight with respect to the weight of the island component of the nonwoven fabric.

Next, a processing was carried out for 30 minutes by soaking this sheet in a sodium hydroxide solution with a density of 15 g/L heated to 90° C. and a sea-less fiber sheet was obtained by removing the sea components of the sea-island type fibers. By observing the surface of the sea-less fiber sheet with a scanning electron microscope (SEM), it was verified that the mean single fiber fineness was 0.04 dtex and the fineness CV was 7.4%. Furthermore, the presence of siloxane bonds was verified by NMR.

After nap raising processing was carried out by cutting the sea-less fiber sheet in half in the direction of the thickness and grinding the cut surfaces using 240 grit endless sandpaper, dyeing was carried out with disperse dyes using a circular dyeing machine and the leather-like sheet material of this invention was obtained.

The quality of the outer appearance, an evaluation of the pilling and the texture of the obtained leather-like sheet material were all excellent.

Examples 11-13

Except for the respective changes in the self-emulsifiable polyurethane aqueous dispersion solution, processing was carried out in a manner similar to Example 10 and the leather-like sheet material of this invention was obtained. The quality of the outer appearance, the pilling evaluation and the texture of the obtained sheet materials were all excellent.

Example 14

Using sea-island type staple fibers (fiber length 51 mm) with a proportion composed of 20 parts of polyethylene terephthalate copolymerized with 8 mol % 5-sulfoisophthalate sodium as the sea component and 80 parts of PET as the island component, a state was produced with 16 island components in one filament a mean fineness of 3.8 dtex, a web was formed by means of a card and cross wrapper, on both surfaces of the web a plain weave fabric using strong twisted yarn with a PET 84 dtex-72 filaments and 2000 T/m twist count was layered, interlaced by means of a needle punch and the nonwoven fabric produced.

This nonwoven fabric was processed and shrunk for 2 minutes in a 90° C. hot water bath and dried for 5 minutes at 100° C. Next, by impregnating it in the self-emulsifiable polyurethane aqueous dispersion solution 18 (PU-18) and hot air drying it for 10 minutes at a drying temperature of 125° C., a sheet was obtained in which the weight of the polyurethane was 85% by weight with respect to the weight of the nonwoven fabric.

Next, a processing was carried out for 30 minutes by soaking this sheet in a sodium hydroxide solution with a density of 15 g/L heated to 90° C. and a sea-less fiber sheet was obtained by removing the sea components of the sea-island type fibers. By observing the surface of the sea-less fiber sheet with a scanning electron microscope (SEM), it was verified that the mean single fiber fineness was 0.21 dtex and the fineness CV was 7.8%. Furthermore, the presence of siloxane bonds was verified by NMR.

After nap raising processing was carried out by cutting the sea-less fiber sheet in half in the direction of the thickness and grinding the cut surfaces using 240 grit endless sandpaper, dyeing was carried out with disperse dyes using a circular dyeing machine and the leather-like sheet material of this invention was obtained.

The quality of the outer appearance, an evaluation of the pilling and the texture of the obtained leather-like sheet material were all excellent.

Example 15

Except for using Ny6 in the island component and using the self-emulsifiable polyurethane aqueous dispersion solution 19 (PU-19), processing was carried in a manner similar to Example 1 and the sheet material of this invention was obtained. The mean single fiber fineness was 0.05 dtex and the fineness CV 7.5%. Furthermore, the presence of siloxane bonds was verified by NMR.

The quality of the outer appearance, the pilling evaluation and the texture of the obtained sheet material were all excellent.

Example 16

Except for using PBT in the island component and using the self-emulsifiable polyurethane aqueous dispersion solution 20 (PU-20), processing was carried out in a manner similar to Example 1 and the sheet material of this invention was obtained. The mean single fiber fineness was 0.04 dtex and the fineness CV 7.9%. Furthermore, the presence of siloxane bonds was verified by NMR.

Example 17

Except for the plain weave fabric being layered on both sides of the web with a proportion composed of 20 parts of polyethylene terephthalate copolymerized with 8 mol % 5-sulfoisophthalate sodium as the sea component and 80 parts of PET as the island component, using a strong forced twisted yarn with a 1200 T/m twist count and a PET 84 dtex-72 filaments and interlacing it with a needle punch, processing was carried out in a manner similar to Example 10, and the sheet material of this invention was obtained. The quality of the outer appearance, the pilling evaluation and the texture of the obtained sheet material were all excellent.

Example 18

Except for producing an nonwoven fabric using sea-island type staple fibers (fiber length 51 mm) with a proportion composed of 45 parts of polyethylene terephthalate copolymerized with 8 mol % 5-sulfoisophthalate sodium as the sea component and 55 parts of PET as the island component, a state produced with 36 island components in one filament of a mean fineness of 2.8 dtex, a web formed by means of a card and cross wrapper and on both sides of the web a plain weave fabric with a proportion composed of a proportion of 20 parts of polyethylene terephthalate copolymerized with 8 mol % 5-sulfoisophthalate sodium as the sea component and 80 parts of PET as the island component layered using strong twisted yarn with 66 T-36 filaments composed of 8 islands and a 2000 T/m twist count and interlaced by means of a needle punch, processing was carried out in a manner similar to Example 10 obtaining the sheet material of this invention. The mean single fiber fineness was 0.04 dtex and the fineness CV 7.5%. Furthermore, the presence of siloxane bonds was verified by NMR.

The quality of the outer appearance, the pilling evaluation and the texture of the obtained sheet material were all excellent.

Example 19

Except for producing an nonwoven fabric using sea-island type staple fibers (fiber length 51 mm) with a proportion composed of 45 parts of polyethylene terephthalate copolymerized with 8 mol % 5-sulfoisophthalate sodium as the sea component and 55 parts of PET as the island component, a state produced with 36 island components in one filament of a mean fineness of 2.8 dtex, a web formed by means of a card and cross wrapper and on both sides of the web a plain weave fabric with a proportion composed of a proportion of 20 parts of polyethylene terephthalate copolymerized with 8 mol % 5-sulfoisophthalate sodium as the sea component and 80 parts of PET as the island component layered using strong twisted yarn with 135 T-72 filaments composed of 8 islands and a 1200 T/m twist count and interlaced by means of a needle punch, processing was carried out in a manner similar to Example 10 obtaining the sheet material of this invention. The presence of siloxane bonds was verified by NMR. The quality of the outer appearance, the pilling evaluation and the texture of the obtained sheet material were all excellent.

Embodiment 20

Except for layering the plain weave fabric on both sides of the web using strong twisted yarn with PET 84 dtex-72 filaments and a 2000 T/m twist count, laying the tricot knit fabric using strong twisted yarn with a 2000 T/m twist count, and interlaced by means of a needle punch to produce nonwoven fabric, the sheet material of this invention was obtained by carrying out processing in a manner similar to Example 10. The quality of the outer appearance, the pilling evaluation and the texture of the obtained sheet material were all excellent.

Comparative Examples 6 and 7

Except for using the respective self-emulsifiable polyurethane aqueous dispersion solutions 21 (PU-21) and 22 (PU-22), the sheet material was obtained by carrying out processing in a manner similar to Example 10. Furthermore, the presence of siloxane bonds was verified by NMR.

The quality of the outer appearance and the texture of the obtained sheet material were both excellent but the pilling evaluation was 1.

Comparative Example 8

Except for the sheet obtained in Example 10 with polyurethane added so that the weight of the polyurethane was 80% by weight with respect to the weight of the island component of the nonwoven fabric before the polyurethane was added by soaking the nonwoven fabric in a sodium hydroxide solution with a density of 15 g/L, processing for 30 minutes, producing a sea-less nonwoven fabric with the sea component of the sea-island type fibers removed, and subsequently impregnating it in the self-emulsifiable polyurethane aqueous dispersion solution 14 (PU-14) and hot air drying it for 10 minutes at 125° C., a leather-like sheet material was obtained by processing carried out in a manner similar to Example 10.

The pilling evaluation of the obtained sheet material was 4.5 but the texture was extremely rigid and the quality of the outer appearance with almost no nap was unacceptable.

Comparative Example 9

Except for the sheet obtained in Example 10 with polyurethane added so that the weight of the polyurethane was 80% by weight with respect to the weight of the island component of the nonwoven fabric by soaking the nonwoven fabric in a sodium hydroxide solution with a density of 15 g/L, processing for 30 minutes before the polyurethane was added and producing a sea-less nonwoven fabric with the sea component of the sea-island type fibers removed and subsequently impregnating it in the self-emulsifiable polyurethane aqueous dispersion solution 23 (PU-23), soaking it in water at 40° C. and wet process solidifying it for 60 minutes, a leather-like sheet material was obtained by processing carried out in a manner similar to Example 10.

The pilling evaluation of the obtained sheet material was low at 3.5, the texture was extremely hard and the quality of the outer appearance with almost no napped fiber was unacceptable.

Comparative Example 10

Except for using the forced emulsion type polyurethane 24 (PU-24), a sheet material was obtained by processing in a manner similar to Example 10.

The texture of the obtained sheet material was excellent but the dispersion of the fibers in the quality of the outer appearance was unsatisfactory and the pilling evaluation was 2.

TABLE 1

| Polyurethanes | Polyurethane type - self-emulsifiable | Polyol | Isocyanate | Internal emulsifier | Quantity of Si (wt %) | Amount of PEG (wt %) | Hydrolyzability resistance (wt %) | Heat sensitive gelling temperature (° C.) |
|---|---|---|---|---|---|---|---|---|
| PU-1 | self-emulsifiable | C5C6PC | IPDI | nonion | 0.4 | 10 | 0.7 | 71 |
| PU-2 | self-emulsifiable | C5C6PC | IPDI | nonion | 0.6 | 11 | 0.2 | 72 |
| PU-3 | self-emulsifiable | C5C6PC | H12MDI | nonion | 0.4 | 12 | 0.4 | 75 |
| PU-4 | self-emulsifiable | C5C6PC | HDI | nonion | 0.2 | 10 | 2.7 | 75 |
| PU-5 | self-emulsifiable | C5C6PC | HDI | anion | 0.2 | 0 | 1.4 | more than 90 |
| PU-6 | self-emulsifiable | 3MPC | HDI | nonion | 0.2 | 7 | 2.4 | 85 |
| PU-7 | self-emulsifiable | 3MPC | HDI | anion | 0.2 | 0 | 0.8 | more than 90 |
| PU-8 | self-emulsifiable | 3MPC | HDI | nonion | 0.1 | 8 | 3.7 | 82 |
| PU-9 | self-emulsifiable | 3MPC | HDI | anion | 0.1 | 0 | 1.5 | more than 90 |
| PU-10 | self-emulsifiable | 3MPC | HDI | nonion | 0 | 9 | 6.2 | 76 |
| PU-11 | self-emulsifiable | 3MPC | HDI | anion | 0 | 0 | 5.3 | more than 90 |
| PU-12 | solvent system | PHC | MDI | — | 0 | 0 | 7.3 | more than 90 |
| PU-13 | Forcibly emulsified | PHC | H12MDI | — | 0 | 0 | 5.6 | 48 |

TABLE 2

| | Polyurethane type | Gap between the polyurethane and the ultra-fine fibers | Film structure | Outer appearance | Anti-pilling property (grade) | Texture |
|---|---|---|---|---|---|---|
| Example 1 | PU-1 | yes | nonporous | ○ | 4.5 | ○ |
| Example 2 | PU-2 | yes | nonporous | ○ | 4.5 | ○ |
| Example 3 | PU-3 | yes | nonporous | ○ | 4.5 | ○ |
| Example 4 | PU-4 | yes | nonporous | ○ | 4.5 | ○ |
| Example 5 | PU-5 | yes | nonporous | ○ | 4.5 | ○ |
| Example 6 | PU-6 | yes | nonporous | ○ | 4.5 | ○ |
| Example 7 | PU-7 | yes | nonporous | ○ | 4.5 | ○ |
| Example 8 | PU-8 | yes | nonporous | ○ | 4 | ○ |
| Example 9 | PU-9 | yes | nonporous | ○ | 4 | ○ |
| Comparative example 1 | PU-10 | yes | nonporous | ○ | 1 | ○ |
| Comparative example 2 | PU-11 | yes | nonporous | ○ | 1 | ○ |
| Comparative example 3 | PU-1 | no | nonporous | X | 4.5 | X |
| Comparative example 4 | PU-12 | no | porous | X | 3.5 | Δ |
| Comparative example 5 | PU-13 | yes | nonporous | Δ | 2 | ○ |

TABLE 3

| Polyurethanes | Polyurethane types | Polyol | Isocyanate | Internal emulsifier | Quantity of Si (wt %) | Heat sensitive gelling property | Heat sensitive gelling temperature (° C.) | Hydrolyzability resistance (%) |
|---|---|---|---|---|---|---|---|---|
| PU-14 | self-emulsifiable | C5C6PC | H12MDI | nonion | 0.4 | yes | 77 | 0.4 |
| PU-15 | self-emulsifiable | C5C6PC | HDI | nonion | 0.2 | yes | 79 | 2.7 |
| PU-16 | self-emulsifiable | C5C6PC | HDI | anion | 0.2 | no | — | 1.4 |
| PU-17 | self-emulsifiable | 3MPC | HDI | nonion | 0.2 | yes | 78 | 2.4 |
| PU-18 | self-emulsifiable | 3MPC | HDI | anion | 0.2 | no | — | 0.8 |
| PU-19 | self-emulsifiable | 3MPC | HDI | nonion | 0.1 | yes | 79 | 3.7 |
| PU-20 | self-emulsifiable | 3MPC | HDI | anion | 0.1 | no | — | 1.5 |
| PU-21 | self-emulsifiable | 3MPC | HDI | nonion | 0 | yes | 78 | 6.2 |
| PU-22 | self-emulaifiable | 3MPC | HDI | anion | 0 | no | — | 5.3 |
| PU-23 | solvent system | PHC | MDI | — | 0 | no | — | 7.3 |
| PU-24 | Forcibly emulsified | PHC | HDI | — | 0 | yes | 97 | 5.6 |

TABLE 4

| | Scrim | | | Stress at 10% extension time | | Weight per unit | | Gap between the polyurethane | | | Anti- | |
|---|---|---|---|---|---|---|---|---|---|---|---|---|
| | Type (T/m) | Twist count | Fiber used | Warp (N/cm) | Woof (N/cm) | area ($g/m^2$) | Polyurethane type | and the ultra-fine | Film structure | Outer appearance | pilling property (grade) | Texture |
| Example 10 | woven fabric | 2000 | single component | 22.5 | 16.0 | 381.0 | PU-14 | yes | nonporous | ○ | 4.5 | ○ |
| Example 11 | woven fabric | 2000 | single component | 22.3 | 14.7 | 383.0 | PU-15 | yes | nonporous | ○ | 4.5 | ○ |
| Example 12 | woven fabric | 2000 | single component | 22.5 | 15.2 | 384.0 | PU-16 | yes | nonporous | ○ | 4.5 | ○ |

TABLE 4-continued

| | Scrim | | | Stress at 10% extension time | | Weight per unit | | Gap between the polyurethane | | | Anti-pilling | |
|---|---|---|---|---|---|---|---|---|---|---|---|---|
| | Type (T/m) | Twist count | Fiber used | Warp (N/cm) | Woof (N/cm) | area ($g/m^2$) | Polyurethane type | and the ultra-fine | Film structure | Outer appearance | property (grade) | Texture |
| Example 13 | woven fabric | 2000 | single component | 22.7 | 15.1 | 376.0 | PU-17 | yes | nonporous | ○ | 4.5 | ○ |
| Example 14 | woven fabric | 2000 | single component | 21.7 | 15.5 | 380.0 | PU-18 | yes | nonporous | ○ | 4.5 | ○ |
| Example 15 | woven fabric | 2000 | single component | 22.1 | 16.3 | 377.0 | PU-19 | yes | nonporous | ○ | 4 | ○ |
| Example 16 | woven fabric | 2000 | single component | 22.0 | 14.9 | 373.0 | PU-20 | yes | nonporous | ○ | 4 | ○ |
| Example 17 | woven fabric | 1200 | single component | 21.4 | 14.8 | 390.0 | PU-14 | yes | nonporous | ○ | 4 | ○ |
| Example 18 | woven fabric | 2000 | sea-island conjugated | 22.8 | 15.5 | 393.0 | PU-14 | yes | nonporous | ○ | 4 | ○ |
| Example 19 | knitted fabric | 1200 | sea-island conjugated | 22.2 | 15.3 | 385.3 | PU-14 | yes | nonporous | ○ | 4 | ○ |
| Example 20 | knitted fabric | 2000 | single component | 22.7 | 15.3 | 388.0 | PU-14 | yes | nonporous | ○ | 4.5 | ○ |
| Comparative example 6 | woven fabric | 2000 | single component | 22.4 | 16.1 | 389.0 | PU-21 | yes | nonporous | ○ | 1 | ○ |
| Comparative example 7 | woven fabric | 2000 | single component | 22.2 | 14.9 | 391.0 | PU-22 | yes | nonporous | ○ | 1 | ○ |
| Comparative example 8 | woven fabric | 2000 | single component | 22.7 | 15.7 | 385.0 | PU-14 | no | nonporous | X | 4.5 | X |
| Comparative example 9 | woven fabric | 2000 | single component | 22.5 | 15.4 | 394.0 | PU-23 | no | porous | X | 3.5 | X |
| Comparative example 10 | woven fabric | 2000 | single component | 22.0 | 14.8 | 374.0 | PU-24 | yes | nonporous | Δ | 2 | ○ |

INDUSTRIAL APPLICABILITY

The leather-like sheet material of this invention may be suitably used in interior materials having an extremely elegant outer appearance such as for furniture, chairs and wall-finishing materials or for seats, ceilings and interiors in automobiles, trains and aircraft, in clothing materials used or used in parts, for example, for shirts, jackets and the upper part and trim of, for example, casual shoes, sport shoes, dress shoes and women's shoes and for briefcases, belts and wallets, and in industrial materials such as wiping cloths and polishing cloths.

What is claimed is:

1. A sheet material comprising:

a self-emulsifiable polyurethane, comprising self-emulsifiable polyurethane molecules, solidified from an aqueous dispersion, the self-emulsifiable polyurethane in a nonwoven fabric composed of ultra-fine fibers with a mean single fiber fineness of at or above 0.001 dtex to at or below 0.5 dtex;

wherein the ultra-fine fibers and the self-emulsifiable polyurethane do not substantially adhere to each other and the self-emulsifiable polyurethane forms a non-porous structure; and wherein a cross-linking structure is formed by siloxane bonds in the non-porous structure of the self-emulsifiable polyurethane, the siloxane bonds having been formed by condensing silanol groups which are part of the self-emulsifiable polyurethane molecules such that siloxane bonds form between the self-emulsifiable polyurethane molecules;

wherein the self-emulsifiable polyurethane contains polyethylene glycol at or above 3% by weight to at or below 30% by weight with respect to the total weight of the polyurethane and interior emulsifers in the self-emulsifiable polyurethane are of a nonion family, and wherein a content of silicon atoms in the non-porous structure of the self-emulsifiable polyurethane is more than 0% by weight to at or less than 1% by weight with respect to the weight of the polyurethane.

2. The sheet material according to claim 1 comprising sheet material in which the nonwoven fabric composed of the ultra-fine fibers is interlaced together with a woven fabric and/or a knitted fabric, wherein at least a part of a constituent yarn of the woven fabric and/or the knitted fabric is a twisted yarn at or above 500 T/m to at or below 4500 T/m.

3. A method for manufacturing the sheet material according to claim 1 comprising:

(1) preparing a sheet using ultra-fine fiber generating fibers composed of a combination of two or more types of high molecular substances with different solubilities with respect to an alkaline aqueous solution;

(2) providing a self-emulsifiable polyurethane by impregnating the sheet prepared in (1) above in a self-emulsifiable polyurethane aqueous dispersion solution; and (3) processing the sheet of (2) above provided with the self-emulsifiable polyurethane in an alkaline aqueous solution causing the ultra-fine fibers to appear.

4. A method for manufacturing the sheet material according to claim 3 wherein a self-emulsifiable polyurethane aqueous solution is used containing no organic solvents or the % by weight is above 0 and at or less than 1%.

5. A method for manufacturing the sheet material according to claim 3 wherein a concentration of the self-emulsifiable polyurethane in the self-emulsifiable polyurethane aqueous dispersion solution is at or above 10% by weight to at or below 50% by weight in the process in which the sheet is impregnated with the self-polyurethane aqueous dispersion solution.

6. A method for manufacturing the sheet material according to claim 3 wherein the ultra-fine fiber generating fibers are sea-island type conjugated fibers.

7. A method for manufacturing the sheet material according to claim 6 wherein the sea component of the sea-island conjugated fibers is a constituent component comprised mainly of terephthalic acid and ethylene glycol and is composed of copolymer polyesters containing 5-12 mol % of 5-sulfoisophthalate sodium with respect to the total acid component.

8. A method for manufacturing the sheet material according to claim 3 wherein the self-emulsifiable polyurethane has a heat sensitive gelling temperature of at or above 55° C. to at or below 90° C.

9. A method for manufacturing the sheet material according to claim 3 wherein, in a process in which the sheet is prepared using ultra-fine fiber generating fibers composed of a combination of 2 or more types of high molecular substances with different solubilities with respect to the alkaline aqueous solution, the sheet is prepared by interlacing the ultra-fine fiber generating fibers in a woven fabric and/or a knitted fabric.

10. An interior covering formed from a sheet material according to claim 1.

11. A cloth formed from a sheet material according to claim 1.

* * * * *

UNITED STATES PATENT AND TRADEMARK OFFICE

CERTIFICATE OF CORRECTION

PATENT NO. : 8,603,925 B2
APPLICATION NO. : 12/095428
DATED : December 10, 2013
INVENTOR(S) : Koide et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 502 days.

Signed and Sealed this
Twenty-third Day of May, 2017

Michelle K. Lee

Michelle K. Lee
*Director of the United States Patent and Trademark Office*